United States Patent [19]

Thatcher et al.

[11] 4,211,199

[45] Jul. 8, 1980

[54] COMPUTER CONTROLLED SONIC FUEL SYSTEM

[75] Inventors: Arthur K. Thatcher, Merritt Island, Fla. 32952; Ed R. McCarter, Maitland, Fla.

[73] Assignee: Arthur K. Thatcher, Merritt Island, Fla.

[21] Appl. No.: 874,522

[22] Filed: Feb. 2, 1978

Related U.S. Application Data

[62] Division of Ser. No. 593,001, Jul. 3, 1975, which is a division of Ser. No. 293,377, Sep. 29, 1972, Pat. No. 4,100,896.

[51] Int. Cl.[2] ..... F02H 5/00

[52] U.S. Cl. ..... 123/445; 123/590

[58] Field of Search ..... 123/139 AW, 141, 119 R

[56] References Cited

U.S. PATENT DOCUMENTS

| | | | |
|---|---|---|---|
| 890,970 | 6/1908 | Durr | 123/139 AW |
| 1,149,322 | 8/1915 | Barer | 123/139 AW |
| 1,466,092 | 8/1923 | Egersporfer | 123/139 AW |
| 1,730,990 | 10/1929 | Barnhart | 123/139 AW |
| 2,806,519 | 9/1957 | Basford et al. | 123/139 AW |
| 3,145,699 | 8/1964 | High | 123/139 AW |
| 3,425,403 | 2/1969 | May | 123/139 AW |
| 3,487,820 | 1/1970 | Clark | 123/139 AW |

FOREIGN PATENT DOCUMENTS

| | | | |
|---|---|---|---|
| 2529700 | 1/1977 | Fed. Rep. of Germany | 123/139 AW |
| 443585 | 12/1948 | Italy | 123/139 AW |
| 488948 | 1/1954 | Italy | 123/139 AW |

*Primary Examiner*—Wendell E. Burns

[57] ABSTRACT

The computer controlled sonic fuel system employs a fuel computer to convert engine manifold pressure, temperature and RPM into variable fuel pulses which are directed onto the active surface of a sonic fuel dispersion unit. This sonic dispersion unit converts pulses of fuel into a substantially nonpulsating fuel-air mixture having a fuel-air ratio which remains substantially constant regardless of variations in engine manifold pressure, temperature and RPM.

11 Claims, 16 Drawing Figures

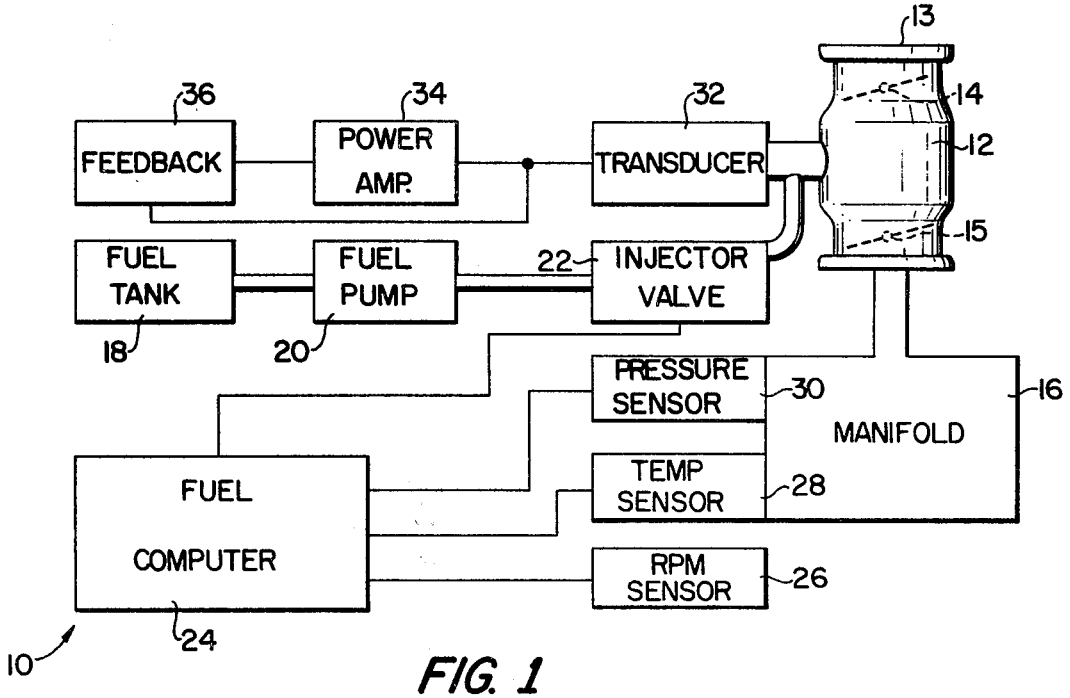
FIG. 1
FIG. 2
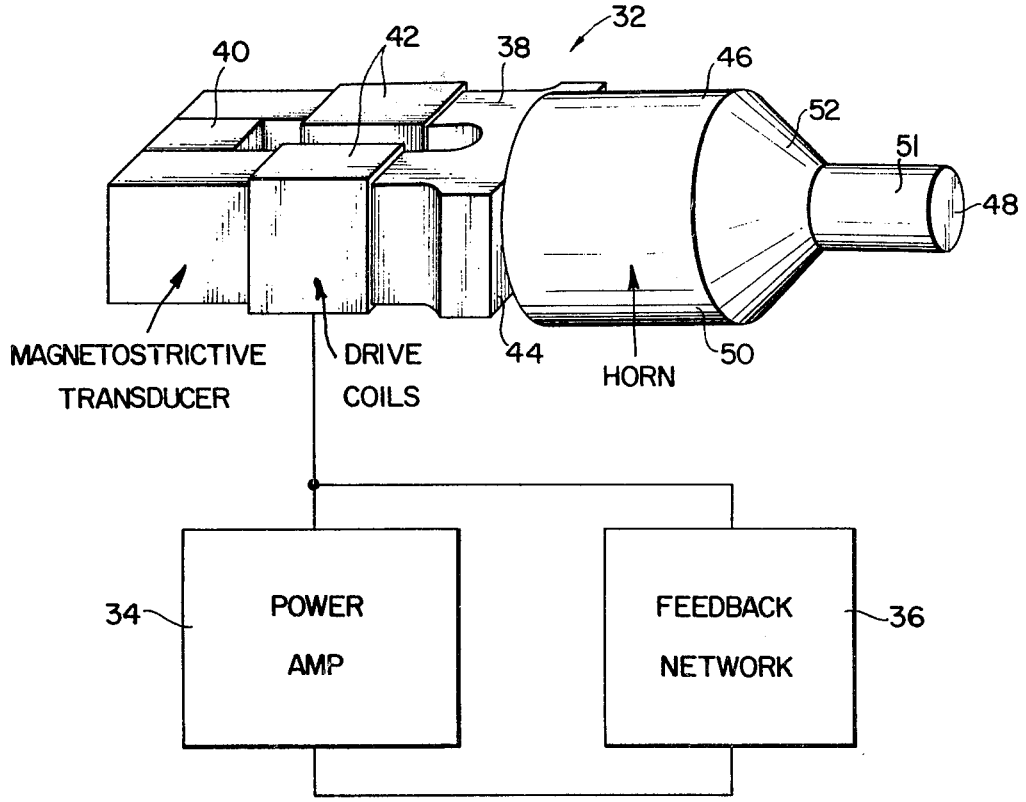

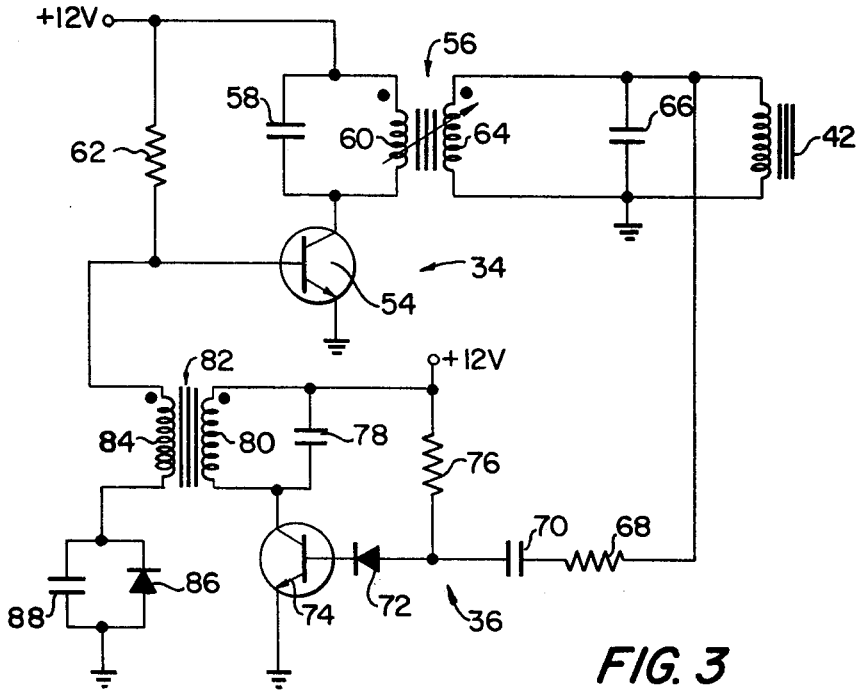
FIG. 3
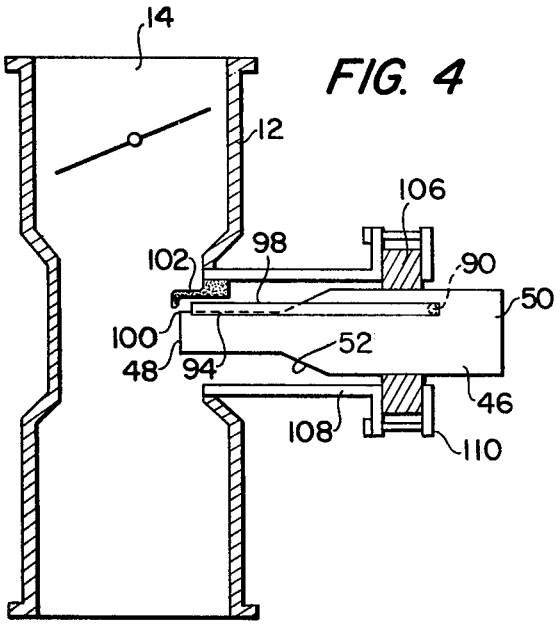
FIG. 4
FIG. 5
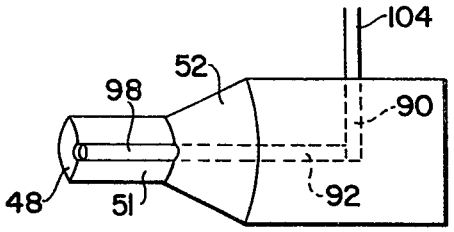

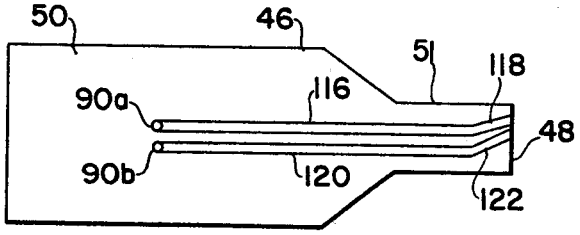
FIG. 6
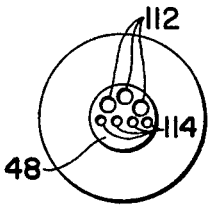
FIG. 7
FIG. 8
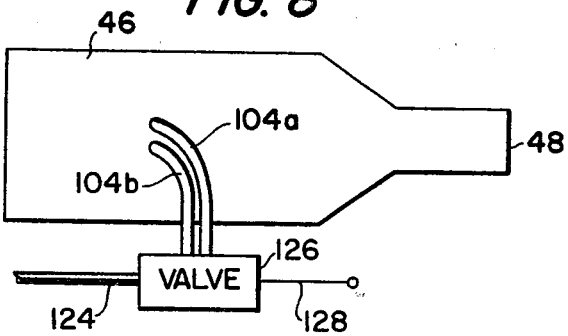
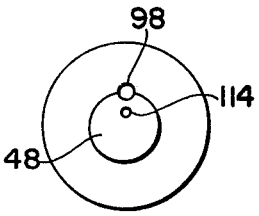
FIG. 9
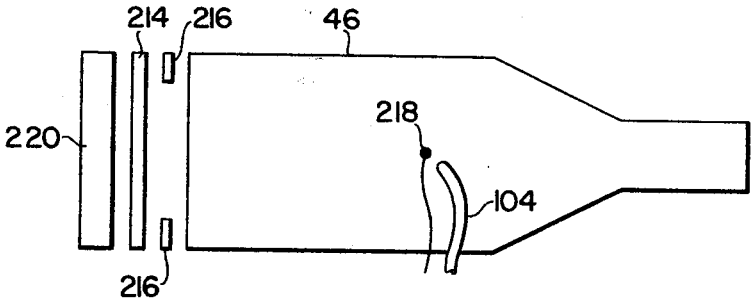
FIG. 15

COMPUTER CONTROLLED SONIC FUEL SYSTEM

This is a division of application Ser. No. 593,001 filed July 3, 1975, which is a division of appln. Ser. No. 293,377 filed Sept. 29, 1972, now U.S. Patent 4,100,896 filed July 18, 1978.

BACKGROUND OF THE INVENTION

Conventional carburetor systems for internal combustion engines are unable to produce consistant molecular suspensions or emulsions of fuel molecules in the air stream drawn into the carburetor, and large droplets of fuel carried by the air stream into the engine cause inefficient and incomplete fuel combustion within the engine. Therefore numerous attempts have been made to develop fuel feed systems and carburetor systems which effectively feed liquid fuel at all engine speeds while maintaining a desirable air-fuel ratio. Such attempts have resulted in the development of sonic and ultrasonic carburetor systems to achieve intensive atomization of fuel and therefore an even dispersion of liquid fuel in the combustion air stream. However, previous sonic or ultrasonic mechanisms have failed to operate effectively within the varying conditions present in the carburization system of an internal combustion engine.

In an attempt to compensate for the variations in engine operation, fuel injection systems controlled by fuel computers have been developed to inject fuel in accordance with actual engine conditions. However, these injector systems operate in an impulse mode to provide a pulsating fuel supply which is not conducive to uniform fuel-air mixtures.

One conventional fuel computer controlled injection system injects fuel directly into the engine cylinders thereby requiring a plurality of injectors which must withstand high temperatures and pressures. A second fuel injection system injects fuel near the engine intake valve. It is obvious that both of these conventional systems have a minimum distance in which to achieve a proper fuel-air mixture and provide for surface evaporation of fuel particles.

It is a primary object of the present invention to provide a novel computer controlled sonic fuel system which effectively combines the advantages of a fuel computer and a sonic fuel dispersion mechanism to provide a more uniform feeding of fuel and a proper fuel-air mixture for all engine operating conditions.

Another object of the present invention is to provide a novel computer controlled sonic fuel system which eliminates the requirement for a plurality of fuel injectors and the need for injectors capable of withstanding high temperatures and pressures.

A further object of the present invention is to provide a novel and improved computer controlled sonic fuel system adapted to provide a uniform quantity of fuel to each engine cylinder by providing a relatively long path for an air-fuel mixing action.

Another object of the present invention is to provide a novel computer controlled sonic fuel system which combines fuel feed control in accordance with engine operating conditions with sonic induced dispersion of fuel to achieve a substantially constant fuel-air ratio and enhanced fuel combustion.

A further object of the present invention is to provide a novel computer controlled sonic fuel system which incorporates an improved sonic transducer and horn to provide an enhanced fuel-air dispersion.

A still further object of the present invention is to provide a novel and improved computer controlled sonic fuel system which may be effectively and economically incorporated in existing internal combustion engines.

These and other objects of the present invention will become readily apparent upon a consideration of the following specification and claims taken in conjunction with the accompanying drawings in which:

FIG. 1 is a block diagram of the computer controlled sonic fuel system of the present invention;

FIG. 2 is a perspective view of a sonic unit adapted for use with the system of FIG. 1;

FIG. 3 is a schematic diagram of the electrical driving circuit for the sonic unit of FIG. 1;

FIG. 4 is a sectional view of a second embodiment of a sonic unit of the present invention;

FIG. 5 is a plan view of the sonic unit of FIG. 4;

FIG. 6 is a sectional view of a third embodiment of a sonic unit of the present invntion;

FIG. 7 is an end view of the sonic unit of FIG. 6;

FIG. 8 is a side view of the sonic unit of FIG. 6;

FIG. 9 is an end view of a fourth embodiment of a sonic unit of the present invention;

FIG. 15 is an exploded view of a piezoelectric sonic unit for use with the present invention.

Figure 10:
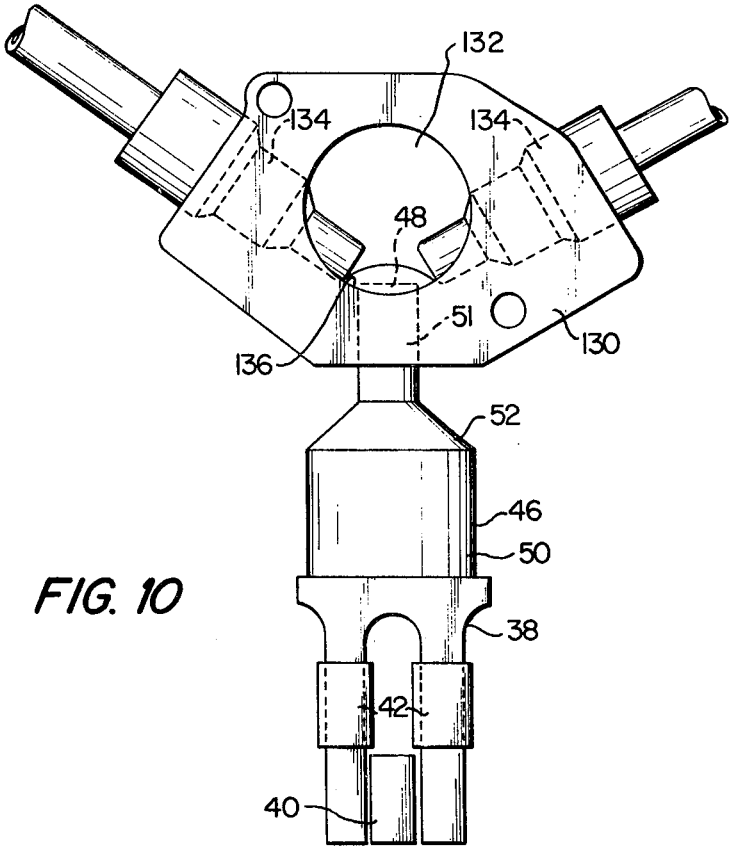
FIG. 10 is a plan view of a fifth embodiment of a sonic unit of the present invention.

Basically, the computer controlled sonic fuel system of the present invention indicated generally at 10 in FIG. 1 includes a fuel computer which receives indications of engine manifold pressure, manifold temperature, and engine RPM. Since the volume of air supplied to an engine is proportional to the pressure and engine speed and inversely proportional to the temperature of the air, the fuel computer is adapted to convert these sensed variables into an electrical control signal which determines the amount of fuel fed to a sonic fuel dispersion unit. The sonic unit provides an effective lengthening of each impulse since, as the fuel strikes the sonic surface, atomization commences immediately and is sustained over a finite period of time, depending upon the size of the control impulse. This tends to give a more uniform feeding of fuel and, when accomplished in an engine at a position in advance of the branching point in the engine intake manifold where the manifold branches out to each cylinder, allows a relatively long path for the air-fuel mixing action.

The computer controlled sonic fuel system 10 may be employed with practically any conventional carburetor 12, such as for example one adapted to provide air from an air intake 13 under the control of a butterfly valve 14 for mixture with fuel to be supplied in response to a conventional throttle plate 15 to an engine manifold 16. This fuel is provided from a fuel supply 18 by a constant pressure fuel pump 20 and is metered by an injector valve 22. The injector valve is operated by a fuel computer 24 which provides a control signal derived from engine RPM, manifold temperature, and manifold pressure, these engine variables being supplied by an RPM sensor 26, a temperature sensor 28, and a pressure sensor 30.

The injector valve 22 provides fuel to a sonic fuel dispersion unit 32 which is adapted to introduce the fuel as minute droplets into the air stream passing to the manifold 16. As will be subsequently described in greater detail, the unit 32 may introduce the fuel directly into the carburetor 12 or may be positioned above the carburetor or beneath the carburetor in the carburetor mounting, as for example beneath the throttle plate. Location of the sonic unit in the carburetor mounting is often quite advantageous if the computer controlled sonic fuel system 10 is to be installed in an existing internal combustion engine fuel system, for with this mounting location, there is no need to modify the existing carburetor to receive the sonic unit.

The sonic unit 32 is driven by an electrical system including a power amplifier network 34 and a feedback network 36. It should be noted that all electrical systems included within the computer controlled sonic fuel system 10 are designed to be powered by a conventional automotive battery.

SONIC SYSTEM

Referring now to FIG. 2, the sonic unit 32 basically consists of a sonic transducer 38 which, as illustrated, may consist of a conventional magnetostrictive transducer having a biasing magnet 40 between the two legs thereof and electrical drive coils 42 for driving the transducer at sonic frequencies. The transducer 38 includes an active surface 44 which drives a power concentrator or horn 46 bonded thereto.

The horn 46 is specifically designed to provide maximum sonic energy at the horn active surface 48. This horn combines the advantages of the conventional tapered horn with those achieved with a stepped horn, and in so doing, eliminates many of the disadvantages of both. This is accomplished ideally by constructing the horn as a one half wave length composite horn with substantially one quarter wavelength sections with relation to the resonant frequency of the transducer 38. The horn includes a first enlarged cylindrical portion 50, a second small cylindrical portion 51 which terminates at the active surface 48, and a tapered or conical section 52 joining the large and small cylindrical portions 50 and 51. The large and small cylindrical sections are of constant diameter and both are of greater length than the intermediate tapered section 52. It may also be possible to design the sections of the composite horn to other lengths which are multiples of the wave length of the resonant frequency of the transducer 38, but for fuel system applications, a composite one half wave length is preferred.

The active surface 48 should be no more than one half the area of the area of a cross section of the enlarged portion 50, and the tapered section 52 may be formed to any configuration sufficient to accomplish this purpose. It is noteworthy that this horn configuration provides the advantages of a stepped horn without the sonic stresses occasioned in such stepped horns by the radical change in the external configuration thereof provided by the step. However, like the stepped horns, the change in horn diameter occurs at a fraction of the operating wave length; in this case, one quarter wave length. The horn may be formed of solid aluminum, or other suitable known material.

Although the horn 46 may be mounted upon a piezoelectric transducer, a magnetostrictive transducer similar to that disclosed in FIG. 2 has been found ideal for engine fuel system applications. This is due to the fact that with the magnetostrictive transducer, a constant resonant frequency is achieved and this controls the frequency of the horn. With thin piezoelectric transducers, the mass of the horn holds the frequency of the transducer down, and the transducer is constantly attempting to increase in vibrational frequency, thereby adding stress to the bond between the transducer active surface and the horn. Also, with magnetostrictive transducers, the cooling requirements are not as severe as with piezoelectric transducers.

The transducer 38 is driven by a power circuit which receives power from a 12 volt automotive battery, or similar power source. As illustrated in FIG. 3, this power circuit includes a power amplifier 34 and a feedback circuit 36, the power amplifier including a power transistor 54 which is connected through a transformer 56 to drive the transducer 38. A tank circuit consisting of a capacitor 48 and a primary winding 60 for the transformer 56 is connected in the collector circuit of the power transistor 54, and is variably tuned to the approximate resonant frequency of the transducer 38. A resistor 62 is connected between the power source and the base of the power transistor 54 to place an initial bias current to the base to aid in starting oscillation.

As the power transistor 54 conducts, the top side of a secondary winding 64 for the transformer 56 becomes positive and causes current to flow in the drive coils 42 for the transducer 38. A capacitor 66 connected across the secondary winding 64 and the drive coils 42 tunes the transducer to eliminate some of the higher harmonics.

The positive going voltage from the drive coils 42 during conduction of the power transistor 54 is coupled by the feedback circuit 36 including a resistor 68, a capacitor 70, and a diode 72 to the base of a transistor 74. A base resistor 76 connected between the power supply and the diode 72 is used to provide an initial bias current to the base of the transistor 74 to aid in initiating oscillation thereof and to provide a leakage path for the base current. A positive voltage to the base of the transistor 74 initiates conduction of the transistor which brings the collector voltage thereof to near zero volts. The collector circuit for this transistor includes a tank circuit consisting of a capacitor 78 and the primary winding 80 of a variable transformer 82. As the collector voltage of the transistor 74 goes to near zero volts, a secondary winding 84 of the transformer 82, which is connected to the base of the power transistor 54, causes a positive voltage to be applied to the base of the power transistor and increases conduction thereof until saturation is reached. As the power transistor saturates, the conduction of the transistor 74 decreases thereby decreasing the conduction of the power transistor, and this process continues until both the power transistor and transistor 74 are turned off. The oscillatory nature of the tank circuits coupled to the collectors of the power transistor and the transistor 74 with the oscillatory nature of the transducer 38 causes this process to repeat, thereby driving the transducer at its resonant frequency. The power transistor 54 and the transistor 74 normally operate in a Class C mode.

A diode 86 and a capacitor 88 connected between the secondary winding 84 and ground provide a return path for the base current for the power transistor 54 while providing a high impedance for the bias current supplied through the resistor 62. Since the magnetostrictive transducer 38 is operable at several resonant frequencies, the tank circuit (78 and 80) in the feedback system 36 provides additional tuning to insure that the circuit operates at the predominant resonant frequency.

The basic horn 46 is quite adaptable to modification to facilitate enhanced fuel dispersion. For example, fuel may be fed through the horn to the active surface 48 as illustrated in FIGS. 4 and 5. To accomplish such internal fuel feed, the horn is not a solid horn of the type illustrated in FIG. 2, but instead includes a fuel inlet 90 which extends substantially perpendicular to the longitudinal axis of the horn. Fuel inlet 90 is formed in the enlarged portion 50 of the horn and communicates with the internal end of a fuel conduit 92 which extends longitudinally of the enlarged portion of the horn and exits through the tapered portion 52 thereof. Coextensive with the conduit 92 is a groove or channel 94 which extends along the top of small cylindrical horn section 51 and terminates at the active surface 48. The conduit 92 and channel 94 receive a length of tubing 98 which is inserted into the conduit 92 so as to communicate with the inlet 90. The tubing 98 must be formed of a non-sound absorbing material such as Teflon, so as not to interfere with the operation of the horn 46, and the end of the tubing adjacent the active surface 48 terminate a short distance inwardly from the end of the channel 94 as indicated at 100. It has been found that enhanced dispersion of fuel as minute droplets occurs only if a thin film of fuel is maintained across the extent of the active surface 48. Fuel must be provided to the active surface in a manner which will permit the fuel to pass across the extent of the active surface from one outer extremity to the opposite outer extremity thereof as a thin film. It has been noted that if the tubing 98 terminates at a point which is even with the active surface 48, large droplets of fuel conducted by the tubing tend to "skate" across the thin film of fuel formed upon the active surface and are thrown into the carburetor air stream. These large droplets are not properly dispersed and therefore reduce the efficiency of fuel combustion.

By positioning the tube 98 within the channel 94 inwardly from the active surface 48, fuel spreads across the active surface to form an effective thin film and large droplets thereof are not permitted to "skate" across the active surface. To prevent the air stream passing through the carburetor from driving the fuel from the active surface 48 before adequate atomization thereof, a shroud 102 is secured above the active surface to divert the carburetor air stream. It should be noted that this shroud may be mounted upon the housing of the carburetor 12 or the shroud may be mounted directly on the horn 46. If the shroud is mounted on the horn, it must be formed of material which will not interfere with the sonic activity of the horn.

The horn 46 must be securely mounted in a manner which will not interfere with the sonic activity of the horn. This is accomplished by making all mounting and fuel connections to the horn in an area of the enlarged section 50 thereof where a sonic null occurs. In the area of this sonic null, the inlet 90 may be formed and a fuel supply tube 104 connected to provide fuel to the inlet. This fuel supply tube should be formed of non-sound absorbing material and may be secured to the horn in any suitable known manner so as not to interfere with the sonic characteristics of the horn. Since the supply tube is connected to the horn in the vicinity of a sonic null point, the connection between the horn and the supply tube will not be subjected to sonic energy which would tend to break the connection.

The mounting of the horn should also occur at the sonic null point and requires that a non-sound absorbing material be the only mounting material in contact with the surface of the horn. Thus, mounting may be achieved by employing an "O" ring 106 of non-sound absorbing material which encircles the enlarged portion of the horn at the null pont and which is compressed between a mounting bracket 108 and a clamp 110. Compression of the "O" ring causes the "O" ring to securely grip the horn to provide an effective mounting therefor which will not affect the sonic activity of the horn.

When the horn 46 is designed to conduct fuel to the active surface 48, it is important that the fuel supply conduits be designed so that a thin film of fuel is maintained across the active surface of the horn. The fuel supply to such active surface should be provided adjacent one extremity thereof so that the fuel is caused to pass across substantially the entire extent of the active surface. Very large fuel outlets in the center of the active surface of the horn have been found to destroy some of the sonic effectiveness provided by the horn, for the greatest area of sonic activity is found at the center of the active surface. Fuel provided at the center of the active surface of the horn undergoes incomplete atomization and very large droplets may be thrown off the airstream by high flow rates.

Once a thin film of fuel has been formed across the active surface of the horn, it is desirable to prevent large droplets of fuel from "skating" across the film and being thrown off into the air stream to the intake manifold before proper atomization occurs. It has been found that a radical change in flow rate, as for example, from idle speed to the running speed, may tend to cause large droplets of fuel to be thrown from the horn into the intake manifold air stream unless some type of fuel feed control is provided. A horn system designed to provide fuel feed control as the engine operation changes from an idle condition to a running speed condition is illustrated in FIGS. 6–9. This horn will provide effective control when direct fuel feed from a fuel pump is employed and will provide very effective control when employed in combination with the fuel computer 24.

With no external fuel control system, when fuel is conducted through the horn 46 to a single fuel opening or a plurality of fuel openings of equal size, the fuel flow will change as the engine changes from an idle condition to a running condition. Thus, if the fuel opening at the active surface is relatively large, high engine RPM during a running condition will prevent fuel from shooting out beyond the active surface and a fuel film will be maintained across the active surface to achieve effective atomization. However, with the same relatively large fuel openings, when the engine slows to idle, fuel in the horn and line will fall from the end of the horn into the air stream.

If the fuel openings in the active surface 48 of the horn are relatively small, an effective fuel film will be maintained across the active surface during engine idle. However, when the engine is in a running speed condition, the increased air flow and fuel pressure will cause fuel to shoot from the small openings at the active surface outwardly into the air stream without properly contacting the active surface. To prevent these conditions which may become prevalent when no external fuel control is employed, a dual fuel feed for the horn 46 of the type illustrated in FIG. 6–9 may be used.

Referring to FIGS. 6 and 7, it will be noted that the active surface 48 of the horn 46 is provided with a plurality or large fuel openings 112 and a plurality of small fuel openings 14. Since the large fuel openings will supply larger droplets of fuel, these fuel openings are positioned closer to the outer extremity of the active surface 58 than are the smaller fuel openings. However, both the fuel openings 112 and 114 should be positioned as close as possible to the outer extremity of the active surface which is the up stream extremity with relation to the flow of air to the engine intake manifold, and may be much smaller than depicted, for illustration purposes, in FIG. 5–9.

To supply fuel to the fuel openings 112 and 114, the horn 46 includes two separate fuel conducting paths. The fuel conducting path for the larger fuel openings includes fuel inlet 90*a* extending into the horn in the null area of the enlarged portion 50 thereof to communicate with a longitudinally extending fuel conduit 116. The fuel conduit 116 extends to the smaller portion 51 of the horn and terminates in a plurality of branch conduits 118 which supply the fuel apertures 112.

Similarly, a fuel inlet 90*b* extends to a second longitudinal fuel conduit 120 which terminates in a plurality of branch conduits 122 connected to supply fuel to the individual small fuel apertures 114. For ease of construction, the branch conduits 118 and 122 may be eliminated and the main conduits 116 and 120 may extend directly to separate fuel supply channels behind the fuel openings 112 and 114.

To alternate the fuel paths to the active surface 48 from a supply line 124 connected to the fuel pump 20, a control valve 126 may be employed. This control valve may constitute any suitable known control valve which is operative in response to either an electrical or mechanical control input to switch the fuel flow from the line 124 to either the input line 104*a* or 104*b*. The fuel input line 104*a* is connected to the fuel inlet 90*a* while the fuel input line 104*b* is connected to the fuel inlet 90*b*.

For purposes of illustration, the valve 126 is shown in FIG. 8 as an electrically controlled valve which operates in response to an electrical signal on the electrical input line 128. Thus, when the engine which is to receive fuel from the horn 46 is at idle, the valve 126 supplies fuel to the line 104*b*, while when the engine changes to running speed, the valve 126 supplies fuel to the line 104*a*. The control signal in the line 128 for the valve 126 may be derived from an RPM sensor, from a microswitch connected mechanically to the accelerator system for the engine, or from any other sensor adapted to indicate a shift from an idle to a running speed condition. Conceivably, this sensor could also constitute a pressure sensor adapted to sense manifold pressure.

Although plural fuel outlets in the active surface 48 of the horn 46 are desirable, these could be replaced by a single large outlet 112 combined with a single small outlet 114. Also, the fuel supply tube 98 of FIG. 5 could be employed in combination with a small fuel outlet 114 as illustrated in FIG. 9 or a plurality of small fuel outlets 114 of the type shown in FIG. 7. With all of these embodiments, the fuel flow control system of FIG. 8 would be employed.

With the horn embodiments of FIGS. 6–9, fuel will be supplied from the small fuel openings 114 when the engine receiving the fuel supply is at idle and the fuel velocity is low, and therefore large droplets of fuel will not be permitted to drop over the active surface 48. The fuel from the openings 114 will spread out around the openings to form an effective fuel film, for the pressure differential created by the intake manifold at idle is not of sufficient magnitude to cause the fuel to jet from the openings 114 away from the active surface. When the engine shifts to running speed, fuel will be provided from the larger openings 112 or the single large opening 98 (FIG. 9) and will again be caused to spread across the active surface 48. These larger fuel openings are of sufficient size to prevent fuel from jetting away from the active surface under the influence of the increased air velocity at running speed, but this increased velocity of air flow will drive the fuel against the active surface of the horn. Also the larger volume of fuel requires additional surface contact for complete atomization, and thus the fuel openings 112 are closest to the outer extremity of the active surface 48.

Fuel fed directly through the horn 46 has the desirable advantages of providing inherent cooling for the horn as well as a unitary fuel supply and sonic system. However, the added expense of providing fuel channels in the horn structure may not be necessary in instances where an external fuel computer is employed. In these situations, the solid horn of FIG. 2 combined with separate fuel injectors as illustrated by FIG. 10 may be utilized.

The sonic fuel injector system of FIG. 10 is designed for use with conventional internal combustion engine carburetor systems without requiring carburetor modification. This system is a low profile system which may be mounted in the space beneath the conventional automotive or truck carburetor between the carburetor and the intake manifold. For this purpose, a special carburetor plate 130 may be employed which is provided with an opening 132 for the air flow from the carburetor plus suitable mounting means for one or more fuel injector nozzles 134. Also the mounting plate 130 may be provided with an opening to receive the small end 51 of the horn 46, the remainder of the horn being suitably mounted as illustrated in FIG. 4. Also, a shroud 136 to protect the active surface 48 of the horn from the air stream may be mounted on the mounting plate 130 or may be secured directly to the horn as previously described.

In the system illustrated by FIG. 10 fuel flow controlled by an external fuel computer is provided to the injector nozzle 134 which then directs the fuel on to the active surface 48. This causes the fuel to form a film across the extent of the active surface between the upstream and downstream extremities thereof. When two fuel injector nozzles are employed as illustrated in FIG. 10, both nozzles are positioned to direct fuel against the upstream outer extremity of the active surface and fuel is alternatively provided through such injector nozzles at slow speeds. As the engine speed increases, both injector nozzles will simultaneously apply fuel to the active surface for a portion of the pulse period. This period of simultaneous injection increases as engine speed increases.

FUEL COMPUTER

The fuel computer indicated generally at 24 (FIG. 11) is a hybrid circuit designed to meter the proper amount of fuel to the active surface 48 of the horn 46. The active surface atomizes the fuel for more uniform mixing with air to minimize combustion pollution products due to an overly rich or overly lean mixture. To produce an optimum combustion, the air-fuel ratio should be such that the fuel is completely burned with a minimum of carbon monoxide due to incomplete combustion and a minimum of unburned hydrocarbons being emitted in the combustion by-products.

To satisfy the above criteria in an internal combustion engine, the air-fuel ratio should be maintained at a given level for all operating conditions of the engine. The volume of air required by the engine is proportional to the intake manifold pressure and engine speed and inversely proportional to the air temperature. As the air temperature increases, the quantity of air in a given volume decreases, while as the engine speed increases, the volume of air increases proportionately assuming the intake manifold pressure and air temperature remain constant.

Figure 11:
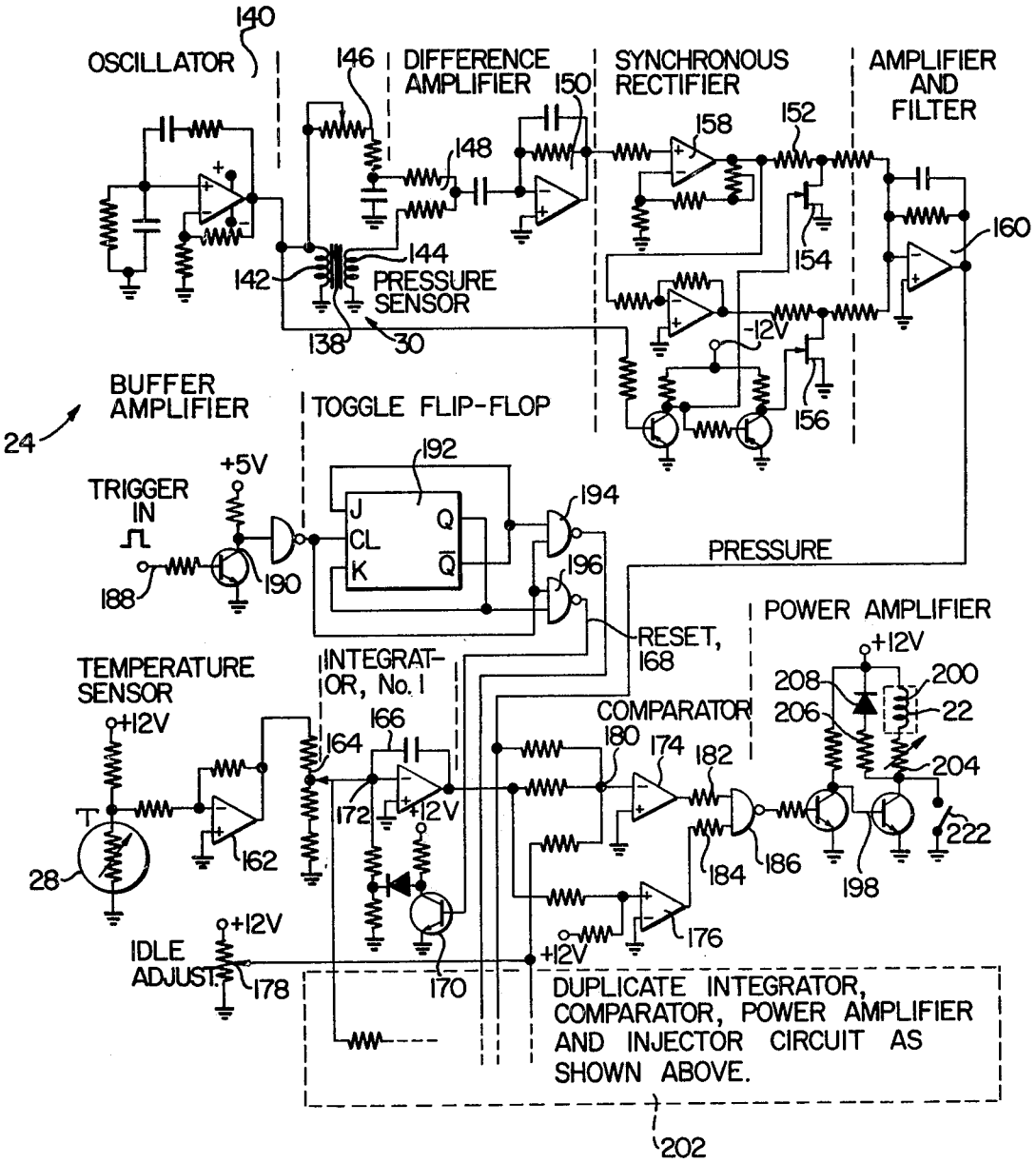
FIG. 11 is a schematic diagram of the fuel computer of FIG. 1.

The fuel computer 24 of FIG. 11 may be employed with any of the sonic horn systems disclosed by FIGS. 4–10. In the systems of FIGS. 4–9, the fuel computer operates a single injector valve which controls the flow of fuel to the horn. In FIGS. 4 and 5, this single injector valve will be placed in the line 104 while in the control system of FIG. 8, the injector valve would be placed in the line 124. In the system of FIG. 10, a single injector valve would again be used if only one fuel injector nozzle 134 is employed, but in the case of multiple fuel injector nozzles, an injector valve will be utilized for each nozzle.

The fuel injector valve 22 may constitute a solenoid operated valve, and with a constant pressure on the fuel supply to the valve, the fuel delivered thereby is proportional to the length of time that the valve remains open. Thus, the fuel computer 24 is designed to supply an electrical control pulse to the injector valve 22 having a duration which is proportional to the intake manifold pressure and inversely proportional to the absolute temperature of the air with a repetition rate which is proportional to the engine RPM. Operating under these conditions, the fuel computer 24 will effectively maintain a substantially constant air-fuel ratio to the intake manifold.

The fuel computer 24 includes a pressure sensor 30 having an electrical transformer 138 with a coupling between the primary and secondary windings thereof which is varied in accordance with sensed pressure. An oscillator 140, which may constitute a Wein Bridge oscillator, is coupled to drive the primary winding 142 of the transformer 138 at a constant frequency and amplitude. The secondary winding 144 of the transformer is polarized so that a secondary voltage is developed which is 180 degrees out of phase with that in the primary winding.

A portion of the primary voltage from the winding 142 is coupled through a variable zeroing circuit 146 to a resistive summing circuit 148. The summing circuit is also connected to receive the secondary voltage from the secondary winding 144, so that a portion of the primary voltage is added to the secondary voltage and the difference is amplified in a difference amplifier 150. The zeroing circuit 146 is provided to adjust the difference between the primary and secondary voltage to zero at a predetermined vacuum (i.e. 20 inches of vacuum) present during engine idle conditions.

The output of the difference amplifier 150 is connected to a synchronous rectifier 152. It will be noted that the synchronous rectifier is also connected to receive the output of the oscillator 140, so that the synchronous rectifier rectifies the output from the difference amplifier in synchronization with the oscillator output. This is accomplished by driving two field effect transistors 154 and 156 alternatively with the oscillator output signal so as to short to ground the difference signal supplied from the difference amplifier 150 through an amplifier 158 to a respective one of the field effect transistors when such field effect transistor is conducting.

The rectified signal output from the synchronous rectifier 152 provides a negative voltage to the input of an amplifier and filter circuit 160 if the sensed pressure is greater than the zero setting set by the zeroing circuit 146 (i.e. 20 inches of vacuum). Also, in this case, the value of the negative input voltage to the amplifier and filter circuit is proportiononal to pressure.

If the pressure sensed is less than the zero setting set by the zeroing circuit 146 (less than 20 inches of vacuum) the input voltage to the amplifier and filter circuit will become positive and will be proportional to the pressure deviation from the zero setting. The amplifier and filter circuit operates to amplify and invert the input voltage thereto as well as to filter the ripple caused by the oscillator frequency.

The temperature sensor 28 may consist of a thermistor having a resistance which varies inversely in response to the sensed temperature. This temperature sensor may be mounted at any point within the engine where accurate sensing of engine air temperature may be achieved. The thermistor is connected to the voltage suply which may constitute an automotive 12 volt battery, and thus the voltage across the thermistor varies inversely with temperature. This thermistor voltage is amplified by an amplifier 162 and fed to a potentiometer 164 which provides the supply signal to an integrator 166. This integrator is designed to range from minimum to maximum output voltage over a nominal time interval of ten milliseconds, and during this relatively short interval, temperature is assumed to remain constant since it is a slowly varying function. A reset pulse is provided by a line 168 to a reset transistor 170 which operates, in response to the reset pulse, to connect a positive voltage to the input junction 172 of the integrator. This drives the integrator output to a maximum negative value in a relatively short time period (less than 1 millisecond), and at the end of the reset pulse, the integrator output starts to increase in a positive direction at a rate depending upon the sensed temperature and the setting of the potentiometer 164. This output from the integrator is fed simultaneously to a first comparator 174 and a second comparator 176; the first comparator also receiving the output from the amplifier and filter 160.

As the integrator output voltage passes a first voltage level (i.e. minus 8.75 volts), the output from the second comparator 176 changes from a full negative to a full positive output signal. The first comparator 174 will switch from a maximum positive to a maximum negative output signal as the integrator output voltage passes a second more positive value. This second more positive value at which the output from the comparator 174 will switch to a full negative value depends upon the amplitude of the pressure signal obtained from the amplifier and filter 160 and the setting of an idle adjust potentiometer 178 which provides a reference voltage for combination with the pressure output signal and the temperature output signal from the integrator at a summing point 180. This idle adjust potentiometer operates similar to a conventional choke, and may be manually or automatically adjusted to adjust the fuel input to the engine.

The outputs from the comparators 174 and 176 are fed to inputs 182 and 184 respectfully of a NAND gate 186 which operates in response thereto to provide pulses having a width which is proportional to pressure and inversely proportional to the temperature. The timing of the pulse output from the NAND gate is dependent upon a trigger signal applied to an input 188. This trigger signal is derived from the RPM sensor 26 which provides pulses directly from the engine ignition system with a pulse repetition rate which is directly proportional to engine speed, so that a pulse occurs for each intake stroke. These pulses may be obtained from the ignition breaker points or from another suitable device such as a tachometer. The trigger pulse from the input 188 is coupled through a buffer amplifier 190 to a JK flip flop 192. Each input pulse from the buffer amplifier causes the flip flop to change binary state in a known manner so that the output of the flip flop repeats for each alternate input pulse. The outputs from the flip flop 192 are connected to NAND gates 194 and 196 respectively, and these NAND gates also receive the reset pulse from the buffer amplifier 190. It will be noted that the output from the NAND gate 196 provides the reset pulse for the integrator 166, and thus provides the timing for the pulses at the output of the NAND gat1 186. Since these reset pulses are derived from the ignition system, the pulse repetition rate of the pulse at the output of the NAND gate 186 is directly proportional to engine speed.

The output pulses from the NAND gate 186 are connected to a power amplifier 198 which provides an amplified drive pulse to the solenoid coil 200 of the solenoid operated injector valve 22. The time duration during which the drive pulse from power amplifier 198 energizes the solenoid coil 200 to open the solenoid injector valve determines the amount of fuel which is fed either to the horn fuel inlet of FIGS. 4–9 or to an injector nozzle 134 of FIG. 10. In the single valve systems of FIGS. 4–9 and in the event that only a single injector nozzle is employed in connection with the system of FIG. 10, the flip flop and NAND gates 194 and 196 may be eliminated and the output from the amplifier 190 is then directly fed as a reset pulse to the reset transistor 170. This will result in one pulse of fuel being provided by the injector valve 22 for each intake stroke of the engine.

In systems similar to that illustrated in FIG. 10 wherein two injector nozzles are employed, the output of the NAND gate 194 is applied as a reset pulse to a duplicate integrator, comparator, power amplifier and injector system 202 which is identical to that illustrated in detail in FIG. 11. Since the reset pulses from the NAND gates 194 and 196 are provided alternatively, the injector valve 22 and that of alternate system 202 in FIG. 11 are driven in an alternative manner so that fuel is provided to the injection nozzles in FIG. 10 alternatively. This mode of operation also gives one pulse of fuel for each intake stroke of the engine and allows pulses to overlap if required.

Pulses will overlap at higher engine speeds, so that as the engine speed increases, both injector nozzles in FIG. 10 will simultaneously supply fuel to the active surface 48 for longer time periods. The ultrasonic atomization does not occur instantaneously, so that the pulses of fuel are atomized over a longer period of time, thereby providing a more uniform fuel-air mixture than can be obtained without the atomization.

The power amplifier 198 is designed to delay the opening of the injector valves 22 for a set delay period (i.e. 1.5 milliseconds) after a pulse is received from the NAND gate 186 and to delay the closing of the injector valve to achieve closing thereof for an equal delay period after the input pulse from the NAND gate 186 ceases. With this delay in the opening of the injector valves, the fuel may be completely shut off automatically when the intake manifold vacuum exceeds a desired point (i.e. 25 inches of vacuum). This condition exists when the engine RPM is relatively high (greater than 1500 RPM) and the throttle is closed. The advantage of shutting off the fuel at this point is to eliminate the emission of unburned hydrocarbons during engine deceleration and to achieve downhill engine braking.

The power amplifier delay system includes a variable resistor 204 connected in the output circuit of the amplifier 198 and in series with the solenoid coil 200. This resistor may be adjusted to vary the tine required for the current from the amplifier 198 to reach an amplitude sufficient to open the solenoid injector valve.

Similarly, when the pulse output from the amplifier 198 is terminated, the inductance of the coil 200 and the resistance of the variable resistor 204 in series with a resistor 206 determines the time required for the coil current to decay through a diode 208, It will therefore be apparent that at high engine RPM when the throttle is closed, the pulse width from the amplifier 198 will decrease into the delay period set by the variable resistor 204, and thus the solenoid coil 200 will never be energized to open the solenoid valve. Th duration of the delay period may be adjusted by adjusting the variable resistor 204.

It will be obvious that the conventional engine control mechanisms will vary the engine condition sensed by the fuel computer 24 to cause a responsive variation in fuel flow. For example, the throttle plate 15 which moves under the control of a conventional throttle mechanism alters the pressure sensed by the pressure sensor 30.

For some applications, it may be desirable to mix several distinct substances in a controlled manner through the use of the fuel computer 24 and an associated sonic fuel dispersion unit 32. For purposes of description, the substances to be mixed will be considered to be fuel substances, although it is obvious that any liquid substance, and also some powdered substances could be similarly mixed. In the case of two liquid fuels to be mixed, a unit similar to that illustrated by FIGS. 10 and 11 could be employed with separate fuel injector nozzles 134 being adapted to conduct individual components of the ultimate mixture to the active surface 48 of the horn 46. In the case of a two substance mixture, one injector nozzle 134 would be controlled by the injector valve 22 and the solenoid coil 200 while the second injector nozzle would be controlled by the injector valve in the duplicate integrator, comparator, power amplifier and injector system 202. The injector valve 22 would be inserted in a line between a supply for the first fuel substance and the associated injector nozzle 134 while the injector valve in the duplicate system 202 would be inserted in a separate line between the supply for a separate fuel substance and the associated injector nozzle 134. Thus two separate substances could be conducted and mixed at the active surface 48.

Figure 16:
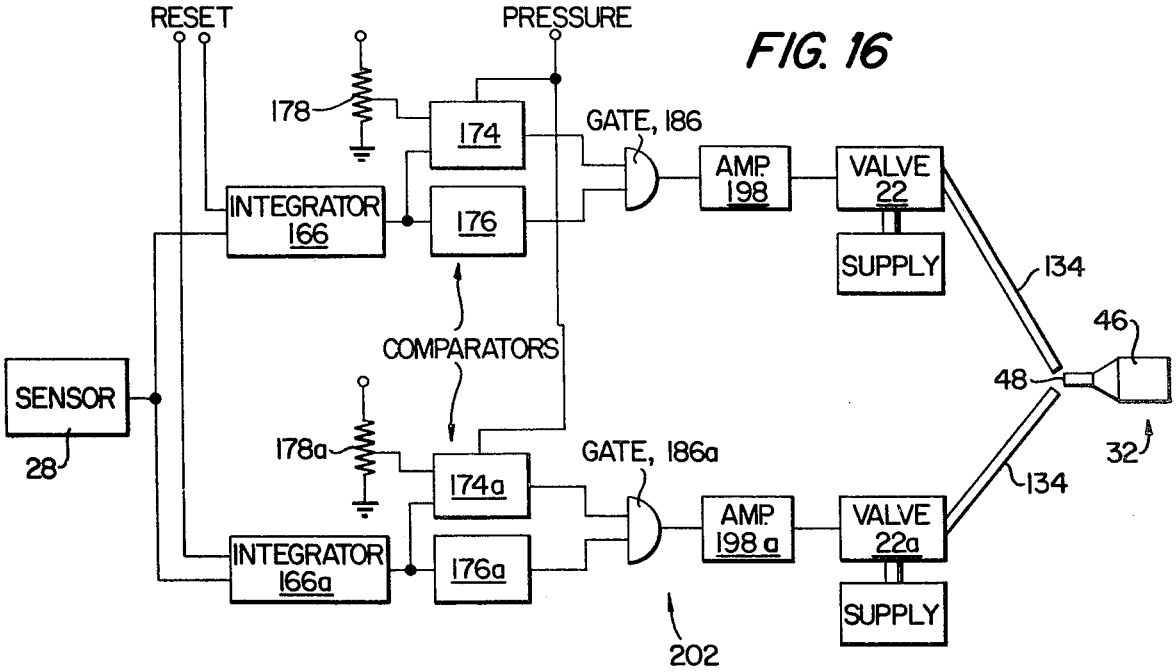
FIG. 16 is a block diagram of a modification of the fuel computer of FIG. 11.

If two separate fuel substances are to be mixed under the control of the fuel computer 24, it may be desirable to mix these substances in some predetermined ratio. To accomplish this, the idle adjust potentiometer 178 would be connected only to the summing point 180, and a separate idle adjust potentiometer would be connected in an identical manner to the duplicate system 202. (See FIG. 16). In FIG. 16, the components of duplicate system 202 are designated by the reference numerals of FIG. 11 plus "a". With this structure, the duplicate system 202 could be caused to provide a different volume of a fuel substance to the active surface 48 of the horn 46 by setting the idle potentiometer 178*a* for the duplicate system at a setting different from that set on the idle adjust potentiometer 178. In this manner, the ratio of fuel components issuing from the fuel injector nozzles 134 could be varied. Also the reset pulses to the integrators 166 and 166*a* might alternate if they originate at the JK flip flop 192 (FIG. 11) or such pulses may pass simultaneously to the integrators 166 and 166*a* if the JK flip flop is eliminated as previously described.

It is obvious that the fuel computer 24 may be employed to operate in response to a wide variety of sensed conditions other than temperature, pressure, and engine RPM. The temperature, pressure, and RPM sensors disclosed in FIG. 1 and 11 could be replaced by any known transducer adapted to provide an electrical signal which is a function of a sensed condition, and thus the fuel computer is adaptable for universal use. For example, the fuel computer could be employed in combination with the sonic unit 32 to provide fuel to a furnace. In this case, temperature and pressure sensors would probably be used in connection with a pulse input which, instead of RPM, would indicate some furnace condition, such as the speed of the furnace blower. In this instance, a variable oscillator of some type might be employed to provide the pulse input to the fuel computer 24, but for other applications, a fixed oscillator or pulse generator could be used.

Figure 12:
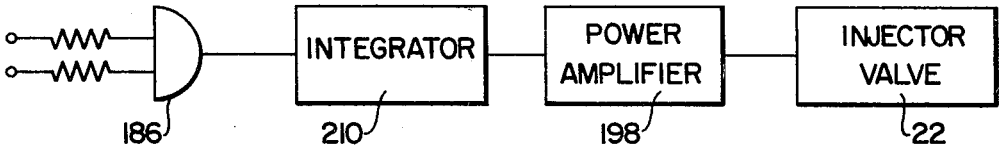
FIG. 12 is a block diagram of the output section of the fuel computer of FIG. 11 modified to provide variable amplitude control pulses.

It may not always be desirable for the fuel computer 24 to provide a variable pulse width output to open and close the injector valve 22 for a predetermined time. As an alternative, the fuel computer is easily modified to provide a variable pulse amplitude output which would vary the amount that the injector valve 22 would open, thereby varying the volume of fuel or other material passing through the valve. This variable amplitude output signal may be easily provided by inserting any well known pulse width to pulse amplitude converter either between the output of the NAND gate 186 and the input to the power amplifier 198 or, between the output of the power amplifier 198 and the input to the solenoid coil 200. For example, as illustrated in FIG. 12, an integrator 210 could be employed between the NAND gate 186 and the power amplifier 198 to convert the variable width pulses from the NAND gate into variable amplitude pulses which would vary the amount that the injector valve 22 is permitted to open.

Figure 13:
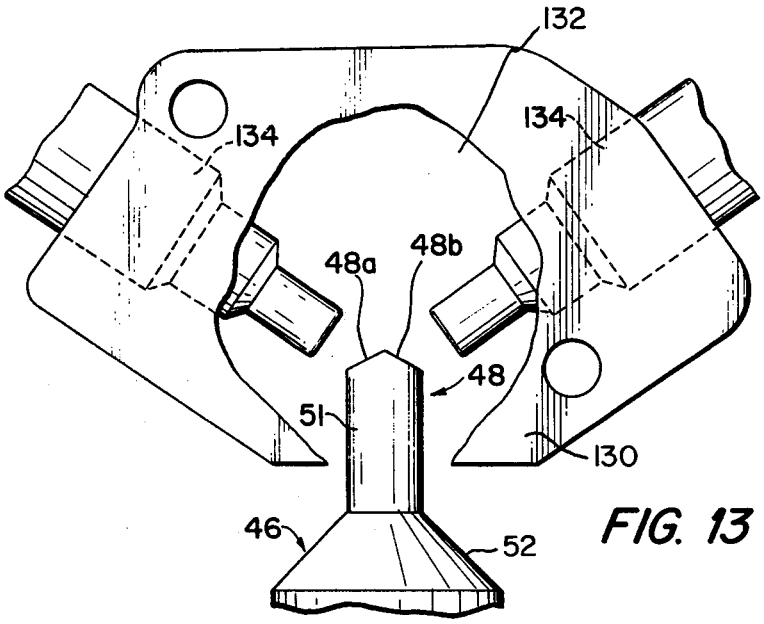
FIG. 13 is a plan view of a sixth embodiment of a sonic unit of the present invention.

With the use of the dual injector system of FIG. 10, several modifications in the structure of the horn 46 are possible. For example, as illustrated in FIG. 13, the active surface 48 of the horn may be divided into two subsections 48*a* and 48*b*, one for each fuel injector nozzle. These active surface subsections constitute flat surfaces formed at the end of the small cylindrical horn section 51 and angled to provide an apex at the center of the small cylindrical horn section at the terminus thereof. The flat subsection 48*a* is positioned to receive fuel ejected from one fuel ejector nozzle while the flat subsection 48*b* receives fuel ejected from the remaining fuel injector nozzle. It has been found that the fuel injector nozzles 134 may be placed at a number of angles with respect to an associated active surface subsection 48*a* or 48*b*, so that the force of the fuel impinging upon the subsection plus the drawing force provided by the sonic vibration of the horn 46 causes the fuel to be drawn along the active surface subsection and over the apex point at the end of the small cylindrical horn section 51. The horn configuration of FIG. 13 is quite advantageous, for the complete active surface causes each fuel impulse to be atomized and directed toward the center of the airstream instead of one side alternately as does the horn of FIG. 10.

Figure 14:
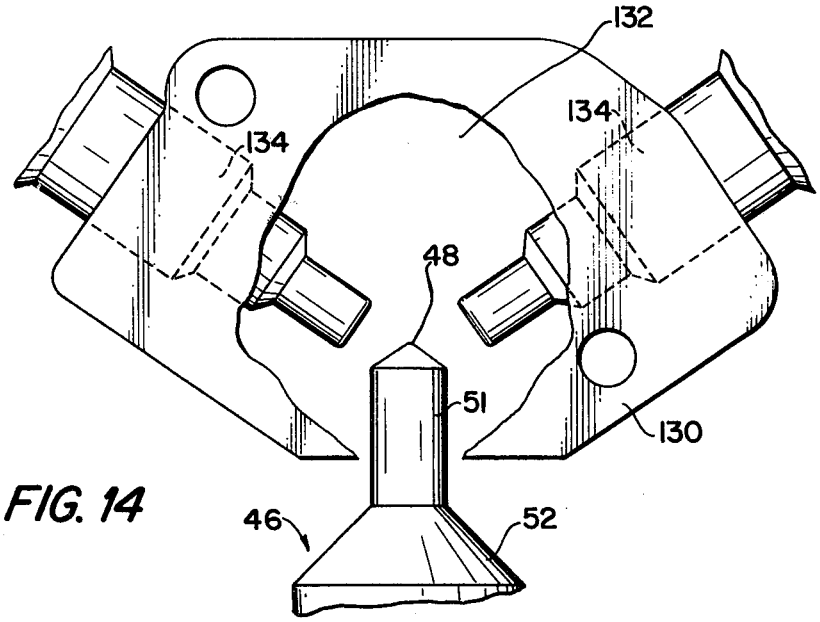
FIG. 14 is a plan view of a seventh embodiment of a sonic unit of the present invention.

In FIG. 14, another modification of the sonic horn 46 is illustrated wherein the active surface 48 constitutes a conical area forming the terminus of the small cylindrical horn section 51 and having an apex at the center of the small cylindrical horn section. With this conical active surface 48, fuel from the injectors 134 spreads to form a thin film of fuel over the entire active surface and the fuel is drawn off at the apex end thereof. This active surface configuration provides more surface area for the atomization of fuel.

As previously indicated, the sonic transducer 38 may constitute a piezoelectric transducer unit rather than a magnetostrictive transducer of the type disclosed in FIG. 2. With reference to FIG. 15, a piezoelectric transducer is bonded to the base of the horn 46 by a bonding material which will not materially affect the sonic capabilities of the combination but which will form a secure bond in the operating environment for the combination. For example, epoxy resin may be employed in some instances to bond the transducer to the horn, and in high temperature applications, a bonding material which will not soften in response to high temperatures must be employed. Positioned between the transducer and the horn are a plurality of spaced, thin shims 216 which contact both the base of the horn and the transducer. These shims may be located 120° apart and perform two important functions. First, the shims are made to correspond to the desired thickness of the bond between the transducer and the horn. For example, if the bond is to be 3/1000 of an inch in thickness, the shims are formed to this thickness to ensure a good uniform bond. Secondly, the shims are made of electrically conductive material and operate to conduct energizing current from the horn to the ceramic transducer. The horn is also formed of electrically conductive material so that electrical connection to an outside conductor may be made at 218 at the sonic null point on the horn. The electrical current for this electrical connection is then transmitted by the body of the horn and the shims 216 to contact points on the ceramic transducer 214.

Bonded to a surface of the ceramic transducer 214 opposite the horn 46 is a backup mass 220 which is preferably formed of a material which is denser than the material forming the horn and which operates to increase the efficiency of the sonic unit.

It will be readily apparent that the novel computer controlled sonic fuel system of the present invention offers a number of unique advantages not provided by conventional fuel systems. The present system requires only one fuel injector and accomplishes fuel injection before the intake manifold branches to the engine cylinders or, in the case of engines of other types, before the combustion area thereof, thus allowing a relatively long path for the air-fuel mixing action. The injector combined with a novel sonic system reduces fuel droplet sizes to provide droplets that may be carried in the air stream around corners and bends encountered in the intake manifold. This produces a more uniform quantity of fuel to each cylinder as compared to a conventional carburetor system or a single injector without atomization. Increased droplet sizes produced by such conventional systems have a greater mass and require more force to produce a given acceleration around a corner. In addition to the more uniform quantity of fuel to each cylinder, the fuel mixture produced by the subject system includes extremely small fuel droplets which have a much larger surface area for evaporation. Since the sonic system provides an effective lengthening of each fuel impulse provided by the respective injector valve, a more uniform feeding of fuel is obtained than can be obtained with conventional injector systems.

By employing computer controlled injection of fuel at a point between a carburetor air inlet and the point where an engine intake manifold branches to the individual engine cylinders, a relatively fail-safe fuel system is provided. For example, should the sonic unit 32 malfunction, this unit may be shut down while the fuel computer 24 still operates effectively to meter fuel through the sonic horn 46 of FIGS. 4–9 and 15 or through the injector nozzles 134 of FIGS. 10, 13, and 14. With the sonic unit deactivated, the sonic horn 46 operates effectively as a conventional fuel nozzle for the carburetor 12.

Even more effective with the sonic unit 32 deactivated is the injector system of FIGS. 10, 13 and 14. Here the active surface 48 of the horn 46 still functions to some extent as a passive fuel dispersion unit to disperse fuel into the airstream through the engine manifold. The pressure of the fuel issuing from the injector nozzles 134 against the now passive active surface 48 of the deactivated sonic unit, causes the fuel to spread across the active surface and disperse into the airsteam. The effectiveness of this fuel dispersion by impingement of fuel against a passive dispersion surface may be controlled by varying the fuel pressure provided by the fuel pump 20.

Should the fuel computer 24 malfunction, the fuel system of the present invention will operate effectively either with or without the sonic unit 32. Thus, the computer may be deactivated, and fuel may still be provided by the fuel pump 20 to the horn 46 of FIGS. 4–9 and 15 or through the injector nozzles 134 of FIGS. 10, 13 and 14 to the active surface 48. Operation with the computer 24 deactivated may be accomplished in a number of ways. For example, a switch 222 (FIG. 11) might be provided to close a power circuit for the injector valve 22 when the computer is deactivated. This shunt power circuit would cause the injector valve to remain open and pass fuel to the sonic unit 32. Obviously, a bypass system for the injector valve 22 provided with a bypass valve actuated upon deactivation of the computer could be employed to provide fuel to the horn 46 or the injector nozzles 134.

We claim:

1. In an internal combustion engine having an intake manifold, an air source for providing an airstream for entry into said intake manifold and a fuel source for said internal combustion engine, a fuel system for providing fuel from said fuel source to the airstream for the intake manifold at a point before said intake manifold reaches the combustion area for said engine, comprising fuel input means connected to supply fuel from said fuel source, fuel dispersion means mounted adjacent the path of said airstream for receiving fuel at a point adjacent the path of the airstream and redirecting said fuel as a fuel dispersion at an angle relative to the direction of the flow of said airstream and toward the center of the airstream at a point before the airstream reaches the combustion area for said engine, said fuel dispersion means having at least one inclined fuel receiving surface extending toward said airstream, the outermost end of said fuel receiving surface terminating at an apex directed toward and spaced from the center of said airstream, and fuel directing means connected to receive the fuel from said fuel input means for directing fuel against said fuel receiving surface, said fuel directing means being mounted in spaced relationship to said fuel receiving surface, said fuel receiving surface being angularly inclined relative to said fuel directing means to redirect fuel from said fuel directing means past said apex toward the center of said airstream.

2. The fuel system of claim 1 wherein said fuel directing means operates to direct fuel under pressure against said fuel receiving surface to cause dispersion of fuel by said fuel receiving surface, said fuel receiving surface being static.

3. The fuel system of claim 1 wherein said fuel dispersion means includes sonic transducer means having an active vibrating surface which forms said fuel receiving surface, said fuel receiving surface in being formed to redirect fuel from said fuel directing means toward the center of said airstream when said active vibrating surface is in either a vibrating or a static condition.

4. The fuel system of claim 3 wherein said fuel receiving surface is conical in configuration and extends angularly away from said apex.

5. The fuel system of claim 3 wherein said fuel directing means includes at least two fuel injector nozzles positioned to direct fuel onto said fuel dispersion means, said fuel dispersion means including a first flat fuel receiving surface section positioned to receive fuel from a first of said fuel injector nozzles and a second flat fuel receiving surface section to receive fuel from a second of said fuel injector nozzles, said first and second flat surface sections being inclined to form a central apex at the juncture therebetween, said central apex extending toward and being spaced from the center of said airstream.

6. The fuel system of claims 4 or 5 which includes shroud means mounted above said fuel dispersion means to divert the airstream relative to said fuel dispersion means.

7. The fuel system of claim 1 wherein said fuel system includes mounting means for said fuel directing means and fuel dispersion means secured between the entrance to said intake manifold and the source for said airstream to the intake manifold, said mounting means including an open ended chamber positioned between said airstream source and the intake manifold for receiving the airstream from the source thereof and directing the airstream to the entrance of said intake manifold, said fuel dispersion means being mounted by said mounting means with said fuel receiving surface positioned within the chamber at a point adjacent the path of the airstream therethrough.

8. The fuel system of claim 7 wherein said mounting means is formed by a substantially flat plate, said chamber being defined by an opening formed in said plate and extending therethrough, and an air diversion means mounted upon said plate above said fuel receiving surface, said air diversion means acting to divert the air stream through said chamber relative to the fuel receiving surface.

9. The fuel system of claim 1 wherein said fuel directing means includes at least two fuel injector nozzles positioned to direct fuel onto said fuel dispersion means, said fuel dispersion means including a first flat surface section to receive fuel from a first of said fuel injector nozzles and a second flat surface section to receive fuel from a second of said fuel injector nozzles, said first and second flat surface sections being inclined to form a central apex extending toward the center of said airstream.

10. The fuel system of claim 1 which includes shroud means mounted above said fuel dispersion means to divert the airstream relative to said fuel dispersion means.

11. The fuel system of claim 1 wherein said fuel receiving surface is conical in configuration and extends angularly away from said apex.

* * * * *